United States Patent [19]

Huemer

[11] Patent Number: 4,837,878

[45] Date of Patent: Jun. 13, 1989

[54] RECLINING OR SEATING MEMBER

[76] Inventor: Hermann Huemer, Schützenstrasse 21, A-6800 Feldkirch-Altenstadt, Austria

[21] Appl. No.: 163,828

[22] PCT Filed: May 16, 1987

[86] PCT No.: PCT/EP87/00260

§ 371 Date: Jan. 20, 1988

§ 102(e) Date: Jan. 20, 1988

[87] PCT Pub. No.: WO87/07125

PCT Pub. Date: Dec. 3, 1987

[30] Foreign Application Priority Data

May 22, 1986 [AT] Austria ..... 1372/86

[51] Int. Cl.[4] ..... A47C 19/00; A47C 23/18

[52] U.S. Cl. ..... 5/191; 5/236 R; 297/284; 297/460

[58] Field of Search ..... 5/191, 236 R, 236 B, 5/238; 297/284, 460

[56] References Cited

U.S. PATENT DOCUMENTS 2,788,531 4/1957 Dye et al. ..... 5/191
4,155,592 5/1979 Tsuda et al. ..... 297/284

FOREIGN PATENT DOCUMENTS 205123 12/1908 Fed. Rep. of Germany .
1113796 9/1961 Fed. Rep. of Germany .
1138818 6/1957 France .
2035792A 6/1980 United Kingdom .

*Primary Examiner*—Alexander Grosz
*Attorney, Agent, or Firm*—Toren, McGeady & Associates

[57] ABSTRACT

A reclining member includes a carrier frame with longitudinal support parts (1,2) at the sides and a reclining surface which is at least partially yielding in a springy or elastic manner. Straps (3,4) extending consecutively are fastened at the side longitudinal support parts (1,2) of the carrier frames transversely to their longitudinal direction. The straps (3) are fabricated of non-extensible material at least in their longitudinal direction, while the straps (4) are elastically extensible in the same direction. The non-extensible straps (3) are constructed so as to be of differing lengths for adapting the reclining surface to the body portion of a reclining person, so that supports at different levels in the regions A to J of a reclining person are present (FIG. 2) which are required for an optimum reclining position.

6 Claims, 2 Drawing Sheets

RECLINING OR SEATING MEMBER

BACKGROUND OF THE INVENTION

The invention is directed to a reclining or seating member, consisting of a support frame and at least one partially flexibly or elastically yielding reclining or seating surface, wherein bands, straps, cables or the like are consecutively fastened at the side longitudinal support parts of the support frame transversely to the longitudinal direction of said support parts.

Reclining or seating members are known which appear to be of a very attractive shape consisting of the most differing materials and also appearing to be in part very adaptable during test use, which however over a long period of use exhibit considerable defects. Thus, for instance the flat soft surface of reclining members is indeed preordained to receive the body in any position and to provide in each position an comfortable feeling for falling asleep or resting. Ailments caused by deformed or displaced intervertebral disks, which exert pressure upon the nerve tissue are frequent causes for back complaints. They occur above all in older persons, where the disk tissue has lost the liquid content and thus the capacity to resist because of daily exposure to stress. The high pressures which stress the vertebral column are thus as a rule reduced only with great difficulty.

If one analyzes the reclining state of one's back in the case of conventional reclining elements at the body, then beginning with the feet one reaches the conclusion that the calf bone particularly stresses the calves so that the blood flow is interfered with. The thigh is always pressed together at the lower side by one's weight. Since these two muscle portions viewed anatomically are located lower than the concave of the knee, the hollow of the knee will rest in a relatively concave manner, which over a longer period again causes a stressing of the ligaments. The lumbar region is relatively well supported, wherein however precisely the lumbar region is the part of the human body which causes the least problems. A healthy vertebral column shows in side view as a slightly swung S, while it is shown in conventional reclining elements, that a support of the vertebral column more or less occurs depending on the weight in the lumbar region or in the shoulder region. Since the lung performs a sort of pumping function during the breathing process in the central region of the vertebral column (belly-chest region), the principal portion of the forces generated thereby inclusively of the mass portions is transmitted to the central vertebral disk portion. Since the reclining elements which have been used so far can be pressed through more or less easily at all points, the vertebral column is slightly pressed downwards at each pumping occurrence of the lung, until it finally forms a hump. The shoulder blade portion is practically a resting portion, however, it is pressed by one's proper weight upwards which proper weight rests on said shoulder blades since the shoulder blades stick out in a raised manner. This entails a tension of the shoulder blade. The vertebral portion of neck is not supported on the known reclining elements. The head lies in very few cases centrally to the rest of the body, so that there result distortions of the vertebrae of the neck.

Reposing in a side position on conventional reclining elements necessitates a sidewise bending of the vertebral column because of the pumping action of the lung. The armpit region or the shoulder blades distort themselves which leads to twisting of the vertebral column. No support for the neck vertebrae is available also in the sideways position. In a side position the head can be only brought into a relative plane with respect to the body by means of a pillow.

It is already known (U.S. Pat. No. 2,788,531) to attach consecutive straps, belts, cables or the like extending at the side longitudinal support portions of the carrying frame of a mattress transversely to the longitudinal direction of said mattress. In this known design all the straps are fabricated to be elastically yielding, however, it is possible that not all the straps extend equally. This is achieved by fabricating the straps in the attachment region of the longitudinal parts from an elastic material, while the strap segments arranged between the end portions are formed of a non-elastic material of different lengths. If no load is applied to the mattress all the straps are under tension in horizontal direction, wherein an elastic travel of different lengths is possible for individual straps when under load. Each strap remains extensible in an elastic fashion even when under load.

SUMMARY OF THE INVENTION

Therefore, the present invention has the object of providing a reclining or seating member with a simple and economical construction enables a comfortable support and regeneration of the body over a long period, for instance during a night's rest.

In accordance with the invention at least a portion of the bands, straps, cables or the like are fabricated at least in the longitudinal direction from non-extensible material, wherein the non-extensible bands, straps, cables or the like are designed to be of different lengths or are attached at different levels to the longitudinal support parts of the carrier frame or are fastened at the longitudinal support parts to be adjustable in length, for adapting to the body portion of a reclining or sitting person.

As a result of these inventive measures, fixedly matched bands, straps, cables or the like are present which are adapted to the anatomical shape of the human body. Since these bands or the like are rigidly connected with the longitudinal side support parts, there follows necessarily because of the round shape of the body, a reposing or sitting position on the reclining or sitting member which is adjusted centrally to the longitudinal axis. The body is thus centered into the middle of the member in accordance with its mass distribution. Thus in a practical manner a solid backing is created, adapted appropriately to the consecutive portions of the body. It is thus quite essential that an adaptation to the consecutive portions of the body occur and not an adaptation to the weight of the user, as this is indeed the case in the known embodiment.

Because of the continuous motion of the body caused by the pumping of the lungs a vertical band-through of the spinal column is prevented by this design, and the relocated pressure has an extremely favorable effect, namely it causes a natural traction process on the spinal column.

Accordingly in practice a solid backing is created which adapts to successive body portions in a corresponding manner. It is to be considered as a particular advantage that the measures in the invention can be utilized independently of the weight of the user, thus one does not attach any importance either to soft or hard reclining or sitting members. Tests have shown that the body extends by 1 to 2 cm during a sleeping period of approximately 6 to 7 hours affording an improved blood circulation.

Intervertebral disks absorb liquid when the load on them is relieved, namely by the drawing apart of the spinal column. Traction and tensile devices for relieving the spinal column have been known. These devices are, however, very expensive and it is additionally necessary that the person to be treated is strapped in and is exposed to high tensile forces or remains in a precise position, which is inconvenient for persons in traction on a known base backings.

The design in the invention achieves a stress release of the intervertebral disks, while the person is in a normal lying position.

Additional features of the invention and special advantages are explained with even more particularlity in the following description with the help of the drawing.

BRIEF DESCRIPTION OF THE DRAWING

It is shown on:

FIGS. 9 and 10 are sections taken along the line X—X in FIG. 8 with two different variants for attaching and tensioning the bands, straps, cables or the like.

DETAIL DESCRIPTION OF THE INVENTION

Figure 1:
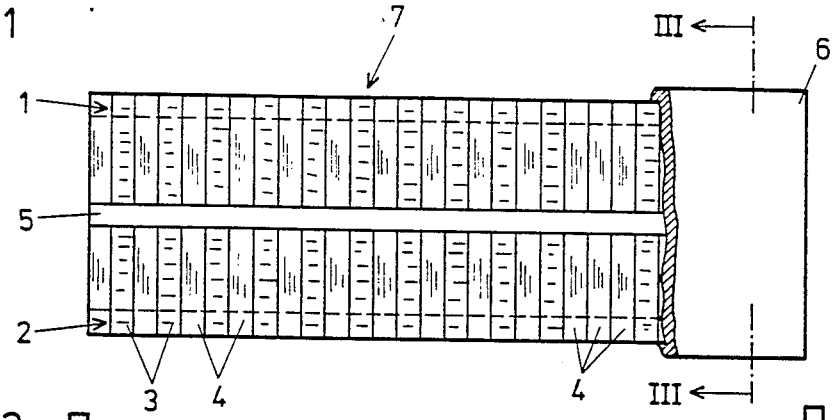
FIG. 1 is a plan view of a reclining member, partially depicted in section.

The depicted reclining member consists essentially of a carrier frame, which is formed, of at least two longitudinal side support parts 1 and 2, as well as straps 3 and 4 extending transversely to the longitudinal direction of said side supports. These straps 3 and 4 are arranged consecutively in longitudinal direction of the reclining member transversely to the longitudinal support parts 1, 2, wherein at least a portion of these straps is fabricated of material at least not extensible in their longitudinal direction. In the embodiment example shown the straps 3 carrying transverse shading are fabricated from non-extensible material and the straps 4 provided with longitudinal shading are fabricated from an elastically extensible material. Instead of straps 3, 4 also bands of other types cables or the like can be utilized within the framework of the invention. It would be conceivable to provide non-extensible straps 3 and to substitute longitudinal flexible elements or other bands, cables or the like for the elastically extensible straps 4. The bands, straps, cables and the like can be fabricated from biological material as well as also from synthetic material. If biological materials are utilized, thus for instance natural fibers, there results a co-reaction of the bands, straps, cables or the like with the body- or environmental climate. Within slight tolerances biological materials automatically adapt to special body shapes as far as their length is concerned. The elastically extensible straps 4 effect a certain springiness of the reclining member, while the non-extensible straps 3 form a support adapted to the shape of the body of the person lying down. In particular it can be discerned from FIG. 2, that the straps 3 are formed of differing lengths for adaptation to the body portions of a person lying down.

Thus it is assured that the person is not subjected to any loads, that the upper thigh is not compressed and that a satisfactory support in the region of the hollow of the knee can occur. Also the lumbar region of the person lying down is optimally supported and in addition it has to be considered as especially essential, that a good support of the spinal column is achieved, so that during the sleeping or resting period the vertebral disk portion is not subjected to additional stresses, rather, on the contrary, a natural traction process occurs.

It has been shown that an approximate adaptation to different body sizes is possible, since the body proportions of people of different sizes are predominantly in similar ratios.

The body requires a certain stress and strain in order to be able to regenerate itself. In case of a corresponding lack of motion there occur the known intervertebral disk- or other ailments. Many people lack strenuous movement because of their profession. A possible compensatory therapy is often ignored or practiced insufficiently. There remains therefore merely the bodily relaxation during the sleeping period in the reclining position. A spinal column oriented in a straight line can itself execute many corrections by a favored moisture circulation and blood circulation. In any case, most people want to lie on a soft and comfortable support. Herein the body is constrained into all sorts of probable and improbably shapes. It does not matter in this case that the head somehow lies on a soft cushion. The neck is buckled by the cushion, the blood circulation is impaired and the very sensitive neck vertabrae remain unsupported. In spite of that one can fall asleep, and what happens afterwards is of little interest to most people. Precisely sleep is of decisive significance for the health, because not only is reclining comfort important, but also the appropriateness of the reclining member.

Figure 2:
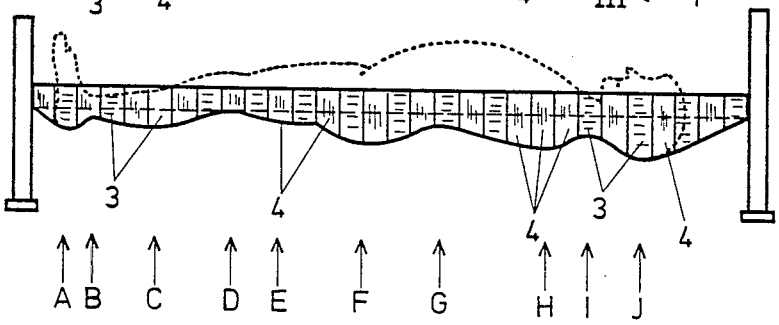
FIG. 2 is a side view of a couch with an inserted reclining member.

The proposed design achieves an optimum support of a person in the reclining position, and in the following the essential support points designated with the letters A to J in the FIG. 2 will be explained in more detail. The heels can be optimally supported upon an elastic strap in the region A. In the region B the hollow of the foot is supported by an inextensible strap. In the region C the lower thighs are supported between the segments B and D formed of non-extensible bands, so that no load worth mentioning is exerted upon the calves in that region. Thus calf and foot cramps can be avoided. In the region D the hollow of the knee is optimally supported by a non-extensible strap. Also, in the region E of the upper thigh there occurs an optimum support and thus an optimum blood circulation because of the partially non-extensible straps, wherein an adjustment of the length of the non-extensible straps appears appropriate for adaptation to the exact body shape. In the region F of the loin there occurs an effective relief by the spinal column bridge in the area G. In the region H the shoulder blades are supported on several consecutively adjacent elastically extensible straps. Thus no distortion of the muscular system occurs and additionally this arrangement is advantageous for receiving the shoulders in the side position. In the region I (neck spinal column bridge) there occurs an orderly support and thus a relief of the neck vertebrae. The region J accepts the head of the lying person, wherein an optimum support of the head without requiring the addition of a head pillow is made possible by the inserted elastically extensible straps.

In the back rest position a central reclining in the longitudinal central plane of the reclining member is possible. By placing a mat upon the reclining member, for instance consisting of a foam material with a covering of fleece wool, a pleasant reclining feeling is additionally created.

In the side position the design has equally positive effects, since the head can in this case also be constantly supported without requiring a head pillow. The spinal column bridge in the region G relieves in this position the side muscular system.

In case of a reclining position upon the abdomen of the person the spinal column bridge in the region B again causes a pleasant relaxation.

The four shortest non-extensible straps in the regions B, D, G and I determine the position of the body with respect to the horizontal plane.

The straps lying in between can be adapted to any body shape. Depending on the change of the level of the spinal column-bridge in the region G the compression or the tension of the longitudinal axis to the spinal column also changes. Thus, it is entirely normal after such a reclining member has been used for several weeks the spinal column is relieved during the night by approximately 3 to 4 cm (measured in the lying down state). The spinal vertebral column bridge in the region I functions also in accordance with this principle. The straps themselves tend to accept the body so as to lie in the center; this is in accordance with the sagging principle. Because of this the spinal column is also oriented in a straight line during the traction process.

Figure 4:
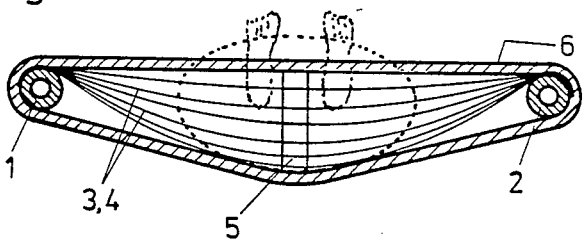
FIGS. 4 and 5 are sections of the same type as in FIG. 3, however, the reclining member is shown subjected to a load by a person.
Figure 5:
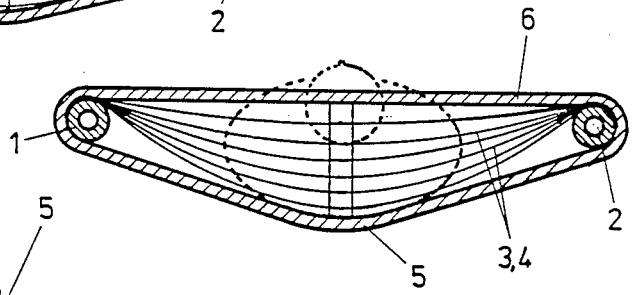

It can be discerned from the sectional drawing in FIGS. 4 and 5 how the individual straps 3 and 4 extend in the course of utilization of the reclining member, whereby the non-extensible straps 3 remain correspondingly taut and the elastically extensible straps 4 abut at the body of the person lying down similar to a spring support.

In most cases it is sufficient if alternately consecutive non-extensible straps 3 and elastically extensible straps 4 are provided. In order to influence the sidewise reclining in an equally favorable manner, two or several elastically extensible straps 4 one behind the other can be arranged for instance at the level of the armpit of the person lying down, wherein then possibly several non-extensible straps 3 are consecutively provided in the region of the reposing head, so that a horizontal line is formed from head to toe.

It is furthermore discernible from the drawing that an elastically extensible longitudinal strap 5 can be arranged between the longitudinal support parts 1, 2 and extending parallel to same. This longitudinal strap 5 is preferably connected at crossing points with all straps 3, 4 which extend transversely thereto. This longitudinal strap is not only intended to reproduce the silhouette of the body, but is also meant to maintain the straps 3 and 4 extending transversely thereto in their positions.

The spring action of the elastically yielding straps 4 is of no particular significance, because these elastically extensible straps are principally meant to assist in a horizontal retention of a mattress placed thereon or of a cover during periods of non-use. In order to form a completed couch the longitudinal support parts 1, 2 together with the straps 3, 4 can be covered by a superimposed mat 6. This assures a practically stepless transition between the individual straps 3, 4, so that an optimum adaptation of the reclining member to the body portions of the persons lying thereon can occur. An advantageous embodiment of this superimposed mat 6 is present if it is designed to be hose-shaped, so that the structure consisting of longitudinal support parts 1, 2 and the straps 3, 4 is enclosed on all sides by the superimposed mat 6.

Figure 3:
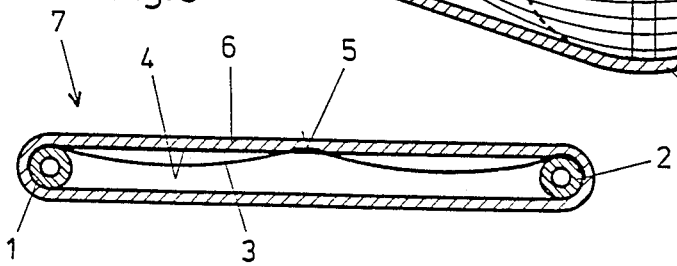
FIG. 3 is a section taken along the line III—III in FIG. 1.

It is discernible from the section in FIG. 3, that the entire reclining member 7 assumes the shape of a flat body if it is not used, wherein for instance the upper side of the mattress is also maintained in a plane by the longitudinal strap 5 and the elastically extensible straps 4. The non-extensible straps 3 sag if not loaded between the sidewise longitudinal support parts 1 and 2 more or less as a function of their length.

Figure 6:
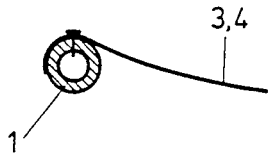
FIGS. 6 and 7 are partial views, partly in section, of two embodiments of the attachment; of bands, straps, cables or the like at the longitudinal side support part.

It is discernible from FIG. 6 that the straps 3 and 4 can be directly connected with the longitudinal support parts 1 or 2 at their ends. The connection can occur in differing ways for instance by riveting or the like.

Figure 7:
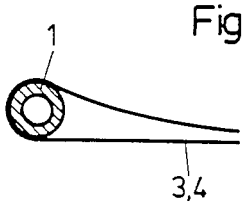

As is discernible from FIG. 7 there exists also another possibility of arranging the straps 3, 4. In this embodiment the straps 3, 4 are designed to constitute endless loops and embrace both longitudinal support parts 1, 2.

Figure 8:
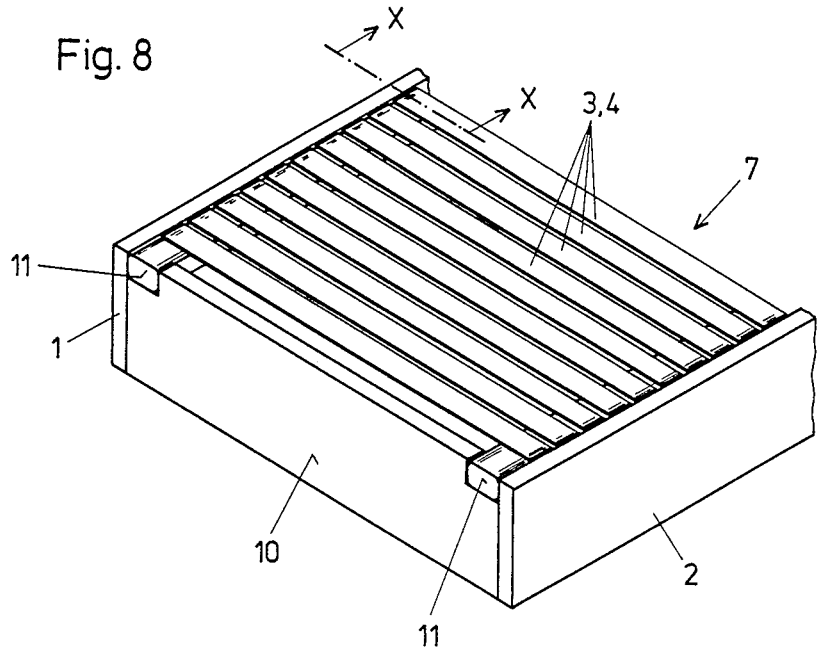
FIG. 8 is a partial oblique view of an additional embodiment of the reclining member.
Figure 9:
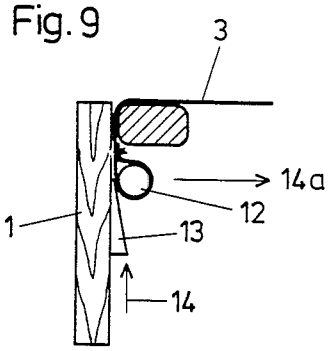
Figure 10:
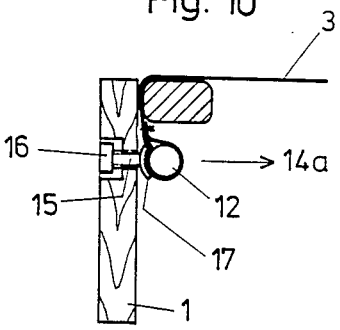

It would also be conceivable within the framework of the invention to provide adjustment possibilities for the non-extensible straps 3, so that in certain circumstances a subsequent adjustment to specific facility is possible in different design versions, as for instance according to the explanation relating to FIGS. 8 to 10.

In the embodiment of FIGS. 8 to 10 the reclining member 7 is also constituted by two longitudinal support parts 1 and 2, which are designed to be plate-like, and the straps 3, 4. Transverse support members 10 are inserted between the ends of the longitudinal support members or parts 1 and 2 in order to form a carrying frame. Ledges, rail sections or the like 11 are rigidly installed extending parallel to the longitudinal support parts 1, 2 and with slight spacing towards the inner side of same, whereby the ends of the straps 3, 4 are led downwards between the inner side of the longitudinal support parts 1, 2 and the ledges 11 and engage with their free end fixedly at a section piece 12. It is possible by this design to make all non-extensible straps 3 equally long, wherein this construction permits a tightening possibility depending on the required length of the straps 3.

The attachment of the free ends of the staps 3 at the section pieces 12 is expediently achieved so that the ends embrace the section pieces 12 in eyelet-like shape. Herein a separate section piece 12 is provided for each free end of the straps 3. This because these straps 3 must be individually adjustable to their length. An advantageous embodiment lies herein in that the one end of the straps 3 is fixed at the one support part 1 or 2, at the corresponding ledge 11, and the section piece 12 is provided merely at one end, in order to thereby constitute a tightening possibility as required.

The tightening can occur by application of force to the section piece 12 provided at the free ends of the straps 3, wherein several design possibilities exist for this. In the embodiment depicted in FIG. 9 a wedge member 13 is inserted between the inner side of one longitudinal support part and the section piece 12 attached at the one free end of a strap 3, which according to necessity is driven more or less towards the top in the direction of the arrow 14. The section piece 12 moves because of this in direction of the second arrow 14a, so that when driving the wedge member 13 further the strap 3 is tightened to a greater or lesser extent.

In the embodiment in FIG. 10 a threaded spindle 15 is provided for each section piece 12 and thus for each strap 3 which threaded spindle acts upon the respective section piece 12, wherein the threaded spindle 15 carries for instance a screw head 16 at the external side of the longitudinal support part 1. An abutment member 17 is provided at the side of the section piece 12 facing the threaded spindle 15, so that if the threaded spindle 15 is screwed in to a greater or lesser extent the section piece 12 and thus the corresponding end of the strap 3 is moved in direction of the arrow 14a. This causes again a stronger tightening of each individual strap 3.

Another not depicted embodiment variant lies in placing at least one end of the strap 3 upon a section piece 12 and winding this end further upon this section piece 12 by rotating said section piece. Tightening or retightening of the straps 3 is also possible in this manner as required. such a variant is however more expensive as far as its design is concerned that the others which have already been illustrated with the help of the sections in FIGS. 9 and 10.

In the design shown in FIGS. 8 to 10 the ledge 11 or a corresponding rail section or the like is expediently provided with multiple connections at the longitudinal support parts 1, 2. This is required because otherwise the whole load through the straps 3,4 would rest upon the ledges 11 when the reclining member is used.

Figure 11:
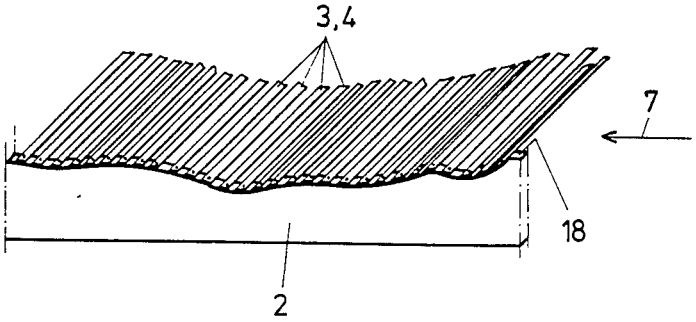
FIG. 11 is an embodiment of the reclining member in oblique view with a special design of the longitudinal support parts.

In the embodiment in FIG. 11 longitudinal support parts 1, 2 of the carrier frame have a contour at their upper and lower longitudinal edges 18 which corresponds to the consecutive body portions of a reclining person. This permits to fasten consecutively non-extensible straps 3 of equal lengths across the length of the longitudinal support parts 1, 2 or also equally long elastically extensible straps 4; these straps are arranged so as to follow one after the other. There results already through the arrangement of the straps 3, 4 the reclining surface contour which is adapted to the body shape. In the embodiment form depicted in FIG. 11 the illustrated longitudinal support part 2 is designed as a plate-shaped part. Within the frame of the invention however it would also be possible to design the longitudinal support parts as tubular or sectional parts as also in the embodiments according to the FIGS. 1 to 7, wherein these are bent along their extent corresponding to the consecutive body portions of the reclining person. Precisely such an arrangement would also be feasible for the fabrication of seating furniture (pure seating furniture, television seats and reclining chairs). In the above descriptions we always discussed a reclining member. Such a reclining member can serve not only as a substitute for known spring element mattresses or the superimposed upholstery mattresses, but also for instance for hospital beds and couches, for therapeutic seating and reclining elements, for chairs, vehicle seats reclining seats and the like.

Because of its simple design measures the present invention is able to create a mattress which enables an optimum reclining position of the user in a manner promoting his health.

I claim:

1. Reclining or seating member, comprising a support frame and at least one partially flexibly or elastically yielding reclining or seating surface, wherein at least one of bands, straps, cables and the like having a longitudinal direction are consecutively fastened at longitudinal side support parts of the support frame and extend transversely to the longitudinal direction of said support parts, characterized in that at least a portion of the bands, straps (3, 4), cables and the like are fabricated of a material at least not extensible in the longitudinal direction thereof, wherein the non-extensible bands, straps (3), cables and the like are formed at least one of different lengths, and fixed at different levels at the longitudinal support parts (1, 2) of the support frame for adapting the reclining or seating member to the body portion of a reclining or sitting person.

2. Reclining or seating member according to claim 1, characterized in that non-extensible bands, straps, cables or the like and elastically extensible bands, straps, cables or the like are provided in an alternatingly side-by-side manner.

3. Reclining or seating member according to claim 1, characterized in that at least one of at least two non-extensible bands, straps, cables and the like and at least two elastically extensible bands, straps, cable and the like are arranged directly following one upon the other in side-by-side relation in selected zones relative to the length of the reclining or seating member (7).

4. Reclining or seating member according to one of claims 1 to 3, characterized in that one of the bands, straps (3, 4), cables and the like are formed as endless loops and extend around both of the longitudinal support parts (1, 2).

5. Reclining or seating member according to one of claims 1 to 3, characterized in that a superimposed mat (6) covers the longitudinal support parts (1, 2) and the one of the bands, straps (3, 4), cables and the like.

6. Reclining or seating member according to claim 5, characterized in that the superimposed mat (6) is hose-shaped and that the structure comprising the longitudinal support parts (1, 2) and the one of the bands, straps (3, 4), cables and the like is enclosed on all sides by the superimposed mat (6).

* * * * *